US005842094A

United States Patent [19]

Bruyndonckx et al.

[11] Patent Number: 5,842,094

[45] Date of Patent: Nov. 24, 1998

[54] CONVEYING DEVICE FOR MAGNETIZABLE PARTICLES

[75] Inventors: Jan Bruyndonckx, Hove; Leo Vackier, 's Gravenwezel, both of Belgium

[73] Assignee: Agfa-Gevaert, Mortsel, Belgium

[21] Appl. No.: 750,724

[22] PCT Filed: Jun. 14, 1995

[86] PCT No.: PCT/EP95/02292

§ 371 Date: Dec. 13, 1996

§ 102(e) Date: Dec. 13, 1996

[87] PCT Pub. No.: WO95/34847

PCT Pub. Date: Dec. 21, 1995

[30] Foreign Application Priority Data

Jun. 14, 1994 [BE] Belgium ..... 9400577

[51] Int. Cl.[6] ..... G03G 15/08

[52] U.S. Cl. ..... 399/289; 198/630

[58] Field of Search ..... 399/289, 294, 399/295; 361/233; 198/619, 630; 310/12, 13; 318/135

[56] References Cited

U.S. PATENT DOCUMENTS

| | | | |
|---|---|---|---|
| 3,113,042 | 12/1963 | Hall . | |
| 3,469,911 | 9/1969 | Olden . | |
| 3,778,678 | 12/1973 | Masuda . | |
| 3,824,516 | 7/1974 | Benowitz . | |
| 4,062,443 | 12/1977 | Wallace et al. | 198/619 |
| 4,113,142 | 9/1978 | Ryzhov et al. . | |
| 4,527,884 | 7/1985 | Nusser | 399/266 |
| 4,647,179 | 3/1987 | Schmidlin | 399/285 |
| 4,700,262 | 10/1987 | Inculet . | |
| 4,960,069 | 10/1990 | Kaieda . | |
| 5,210,551 | 5/1993 | Inoue et al. | 347/141 |
| 5,281,982 | 1/1994 | Mosehauer et al. | 347/55 |
| 5,323,214 | 6/1994 | Kai | 399/289 |
| 5,541,716 | 7/1996 | Schmidlin | 399/258 |
| 5,555,469 | 9/1996 | Ishikawa et al. | 399/258 |

FOREIGN PATENT DOCUMENTS

| | | |
|---|---|---|
| 57-151985 | 9/1982 | Japan . |
| 61-073167 | 4/1986 | Japan . |
| 63-013066 | 1/1988 | Japan . |
| 3-020765 | 1/1991 | Japan . |
| WO9309476 | 5/1993 | WIPO . |

OTHER PUBLICATIONS

IBM Technical Disclosure Bulletin, vol. 26, No. 7A, Dec. 1983, pp. 3450–3451, G.E. Keefe et al. "Non–Mechanical Printing Toner Transport System"; cited in the application — see whole document.

*Primary Examiner*—Robert Beatty
*Attorney, Agent, or Firm*—Baker & Botts, L.L.P.

[57] ABSTRACT

An apparatus used in electrophotographic printing or copying for conveying magnetically attractable toner or developer particles that includes a stator, electric windings, and an end-plate made of magnetizable material arranged in parallel with the major dimension of the stator. The end-plate and the stator define a channel therebetween in which the particles are conveyed. Electric current supplied to the windings creates a magnetic field whose force moves the particles within the channel. This apparatus may be realized by converting a linear induction electromotor having a stator, an armature, and a translator and replacing the armature and translator with the magnetizable end-plate. Alternatively, this apparatus may be realized by converting a linear induction electromotor having a double stator and a translator and replacing one of the stators and the translator with the magnetizable end-plate.

11 Claims, 5 Drawing Sheets

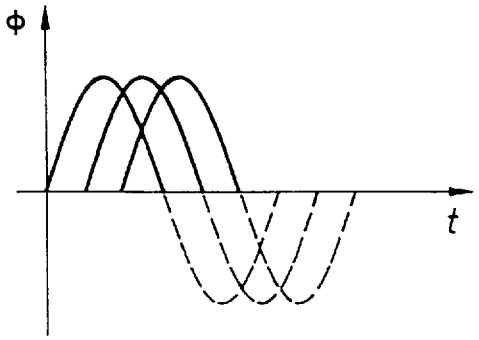
FIG. 6.1
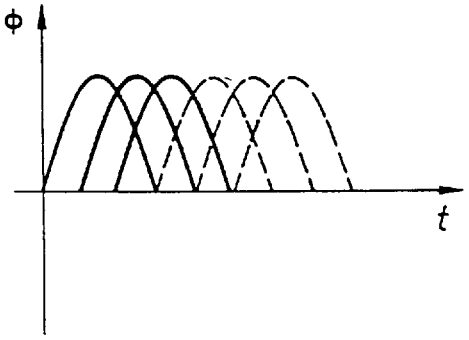
FIG. 6.2
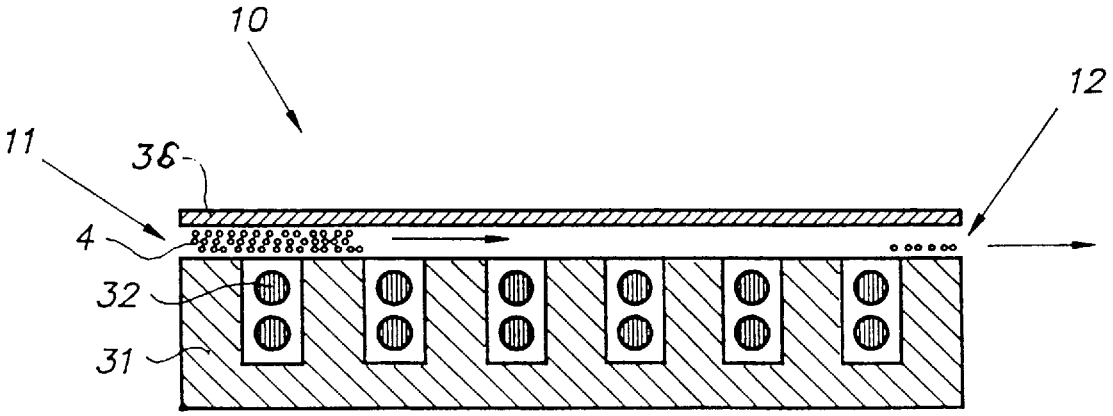
FIG. 7

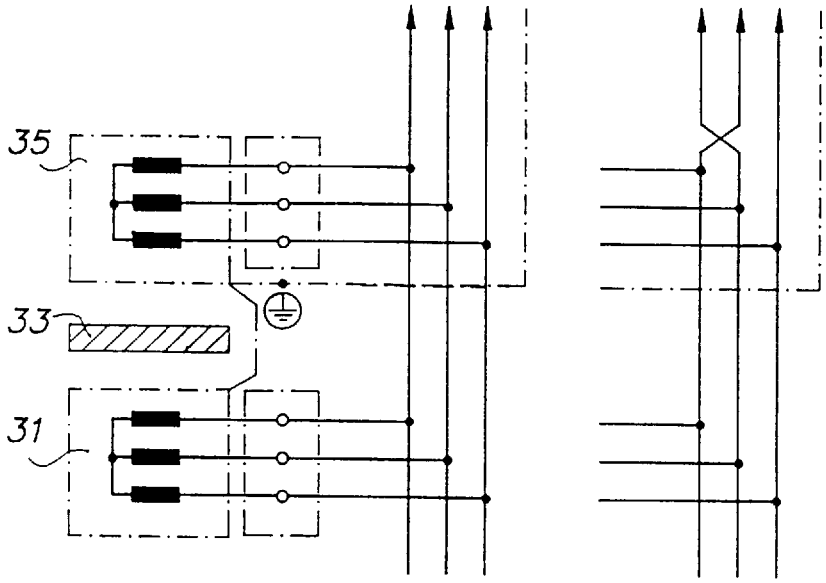
FIG. 10.1
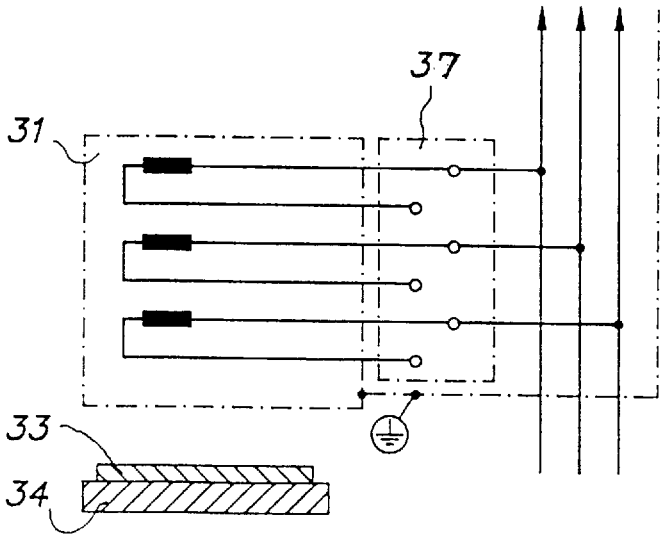
FIG. 10.2

CONVEYING DEVICE FOR MAGNETIZABLE PARTICLES

BACKGROUND OF THE INVENTION

1. Field of the Invention

The present invention relates to a device for conveying magnetizable particles from a first position to a second position by means of a moving magnetic field produced by a converted electromotor and more particularly to a device for the electrostatographic development of a latent image.

2. Description of the Related Art

The art of electrostatic printing or copying involves the formation of an image by the steps of (i) applying on a dielectric an image-wise charge distribution, also called latent image, and (ii) developing the latent image, i.e. converting the latent image to a visible image by depositing selectively light-absorbing particles, called toner particles, on the latent image. The image made visible as a result of the deposition of toner particles on the latent image that was present on the dielectric is then transferred to a substrate and fixed on it to obtain the final print.

In electrophotographic printing or copying, a specific application of electrostatic printing or copying, the dielectric is a photoconductor and the image is formed by the steps of (i) uniformly charging a photoconductor, (ii) image-wise discharging the uniformly charged photoconductor for obtaining thereby a latent image, and (iii) developing the latent image, i.e. converting the latent image to a visible image by depositing selectively light-absorbing particles, called toner particles, on the latent image. The image made visible by the deposition of toner particles on the latent image that was present on the photoconductor is then transferred to a substrate and fixed on it for obtaining the final print.

In the application of toner development two processes are known, i.e. dry-powder development and liquid-dispersion development. The present invention relates to the dry-powder development. For further details on such dry-powder development reference is made to a.o. "IEEE Transactions on Electronic Devices", Vol. ED-19, No. 4, Apr. 1972, pp. 495–511.

According to the dry-powder process the toner particles are charged tribo-electrically as a result of their being mixed with carrier particles. A mixture comprising toner particles and carrier particles, possibly in admixture with further additives, is called developer.

Basically, xerographic copiers and printers 1 commonly use a developing system 2 with a magnetic brush 3 (see FIG. 1, which shows a schematic diagram of a magnetic-brush developing unit as known in the art) for transferring toner particles 4 from a supply 5 to a development zone 6 on an image carrier, e.g. a semiconductor photoconductive drum 7. On such a magnetic brush the developer particles commonly are provided as bristles on the surface of the outer sleeve. Said bristles are transferring toner to the development zone 6 on the photoconductive drum charged with a latent electrostatic image.

The amount of drawn particles 4 is controlled by a coating-thickness control means or doctor blade 13 before reaching the development zone 6. Part of the conveyed particles is picked up electrostatically by the photoconductor 7, whereas the remaining particles continue to move throughout the surface of the magnetic sleeve 8 and eventually return to the supply holder 5 after having passed a scraping means or cleaning blade 14. Optionally, a mixing system 15, such as a rotating paddle, may ensure an intimate mixing of toner and carrier particles. To prevent toner exhaustion a feed system or toner hopper 16 is provided. e.g. with a feed roller 17. Optionally, a bias voltage 18 may be applied to the developing system 2, e.g. to prevent fogging.

A variety of magnetic brushes is available, i.e. types with stationary magnetic core and revolving outer sleeve, types with revolving magnetic core and stationary outer sleeve, or types with revolving magnetic core and revolving outer sleeve. Developing systems with magnetic brushes are described a.o. in "HITACHI components for electrophotographic printing systems", pp. 5–11, published by HITACHI METALS INTERNATIONAL Ltd., Purchase, 2400 Westchester Avenue, N. Y. 10577, U.S.A.

Due to mechanical restrictions the use of a similar magnetic brush suffers from limitations of applicable speed and of technical reliability.

A developing device that is not involving the use of moving permanent magnets has been disclosed by Keefe and Yarmchuk under the heading "Non-mechanical printing toner transport system" in the IBM Technical Disclosure Bulletin, Vol. 26, No. 7A, Dec. 1983, pp. 3450–3451. Reference is made in that respect to FIG. 2, which is a schematic diagram of a similar developing unit 20 with electrically alternating fields according to the above-mentioned disclosure, two electric conductors 21, 22 being mounted perpendicularly to the required translation 25 of the toner particles 4 controlled by binary pulses 23, 24 that are not concurrent in time.

OBJECT OF THE INVENTION

It is an object of the present invention to provide a device for conveying magnetically attractable particles from a first position to a second position without involving the use of mechanically moving permanent magnets.

It is a further object of the invention to provide an alternative developing device with an accurate and reproducible control of the development, wherein the particles travelling path and travelling speed are dependent mainly on electrical parameters, and thus determined to a lesser extent by auxiliary mechanical devices, and a higher reliability is obtained thereby.

Further objects and advantages of the present invention will become apparent from the detailed description following hereinbelow.

SUMMARY OF THE INVENTION

The objects of the present invention are realized by providing a device for conveying magnetically attractable particles from a first position to a second position comprising a conveying means located between said first position and said second position and containing a magnetic-field producing means that is transferring said particles from said first position to said second position wherein said magnetic-field producing means is an asynchronous or induction electromotor.

BRIEF DESCRIPTION OF THE DRAWING

The present invention will be described in detail by way of illustration referring to accompanying diagrams, wherein

FIG. 6.1 represents the magnetic flux applied by the windings of a conventional stator:

FIG. 6.2 represents the magnetic flux applied by the windings of a stator fed by semiconductor diodes;

FIG. 7 shows a converted linear motor according to the present invention;

FIG. 10.1 is a standard wiring diagram for a linear electromotor with double stator;

FIG. 10.2 is a wiring diagram for a linear electromotor with single stator with provision for connecting control devices.

DESCRIPTION OF THE PREFERRED EMBODIMENTS

Figure 1:
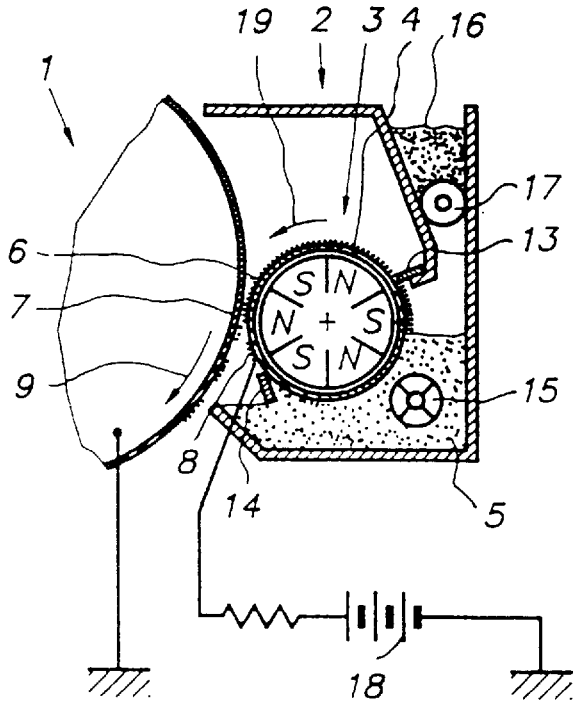
FIG. 1 PRIOR ART
FIG. 1 is a schematic diagram of a magnetic-brush developing unit as known in the art.
Figure 2:
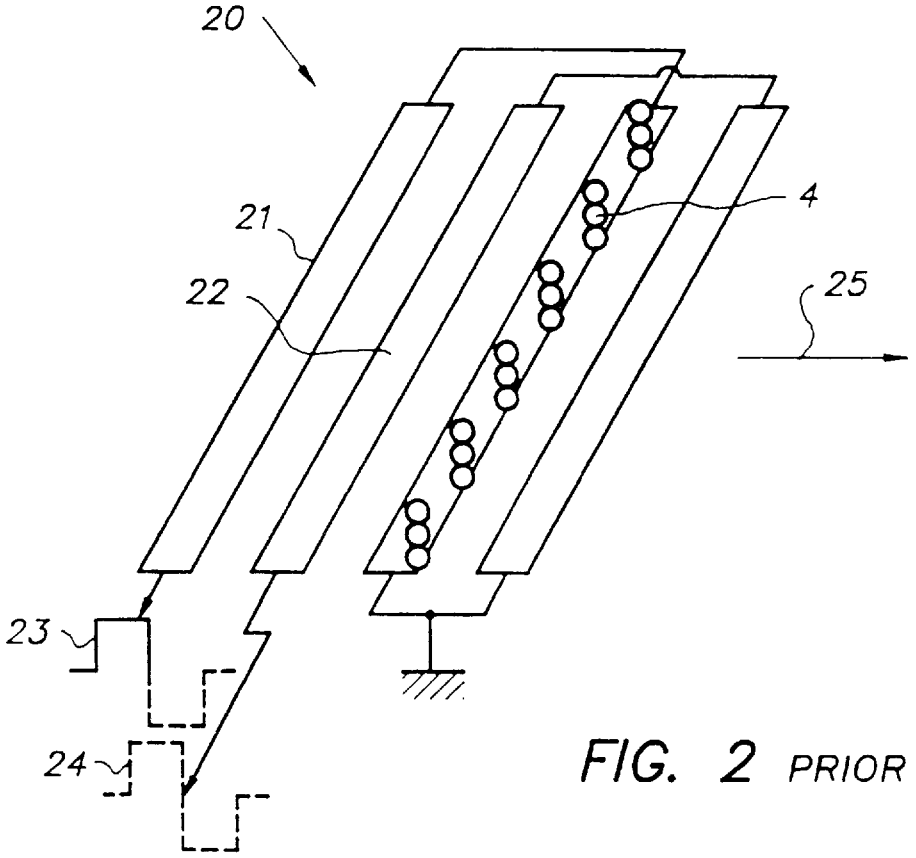
FIG. 2 PRIOR ART
FIG. 2 is a schematic diagram of a developing unit with electrically alternating fields as known in the art.

It will be understood that the present invention is not limited to the specific embodiments described herein. Any person ordinarily skilled in the art may disclose alternative embodiments and applications that are entirely based upon the principle of the present invention.

The present invention relates to a device for conveying magnetizable particles (e.g. xerographic developer) from a first location or position to a second location or position by means of a moving magnetic field produced by a converted electromotor.

Basically, any electric motor may be built according to a rotary and a linear design. As it is assumed that the operation of a rotary electromotor is sufficiently known by those skilled in the art, this type of design will not be illustrated into particulars. In the further description hereinbelow rather the surprising and advantageous use of a converted induction electromotor as conveying device for magnetizable particles will be explained.

Hereinbelow, a first device according to the present invention will be described for conveying magnetically attractable particles from a first position to a second position, comprising a conveying means located between said first position and said second position, and containing a magnetic-field producing means (indicated with reference number 10 in FIG. 9, which will be described further hereinbelow) transferring said particles from said first position to said second position wherein said magnetic-field producing means is a converted asynchronous or induction electromotor. Since both terms, asynchronous electromotor and induction electromotor, are well-known synonyms, one single term will be used in the further description, i.e. induction electromotor.

As a matter of fact, a first series of experiments have been conducted on the basis of a rotary induction electromotor of the type with external rotor. It should be mentioned that similar induction motors with external rotor are rather frequently used in equipment for office automation, motion picture film, magnetic tape, metrology, telephony, etc.

A first series of experiments was e.g. conducted with a converted motor made by PAPST MOTOREN GmbH, Postfach 1435, D-7742 St.-Georgenim Schwarzwald, Germany, of the type Außerläufermotor KM2.80 Q3-53.33.26. The conversion consisted mainly in first removing the external rotor and then replacing it by a smooth plate, film or foil, or sleeve made of non-magnetizable and electrically non-conductive material, e.g. plastic. After connecting the stator to a three-phase power supply it appeared that magnetizable particles in the vicinity of the stator are revolving in the same direction as the magnetic field. The described conveyance of magnetizable particles could be further markedly improved by mounting around the stator and spacing a few mm apart from it an end-plate made of magnetizable material, such as e.g. iron or steel (in FIG. 9, which will be discussed further hereinbelow, such an end-plate is indicated with reference number 36).

Although the present invention may cover both rotary and linear electromotors the further description will mainly focus on an electromotor fit for rectilinear motions.

A linear induction motor is closely related to a rotary squirrelcage induction motor. In this particular case the linear motor may be represented as a rotary motor that was exploded and projected in a plane. Throughout the stator circumference a sliding magnetic field will be created, also called travelling field (by analogy with rotary field in the case of the rotary motor).

The rotor thus becomes a rectilinearly moving translator, sometimes called reaction rail. The stationary part of the motor is still called stator (such as in the case of a rotary electric motor).

The translator currently is made of electrically conductive material. The variation of the magnetic field generated by the currents in the stator windings (also called stator coils) causes eddy currents to flow through the described translator. The magnetic forces on these eddy currents produce the driving force.

Similar (unconverted) linear motors are rather frequently used in linear drives, in conveying plants, railway traction, etc.

Figure 3:
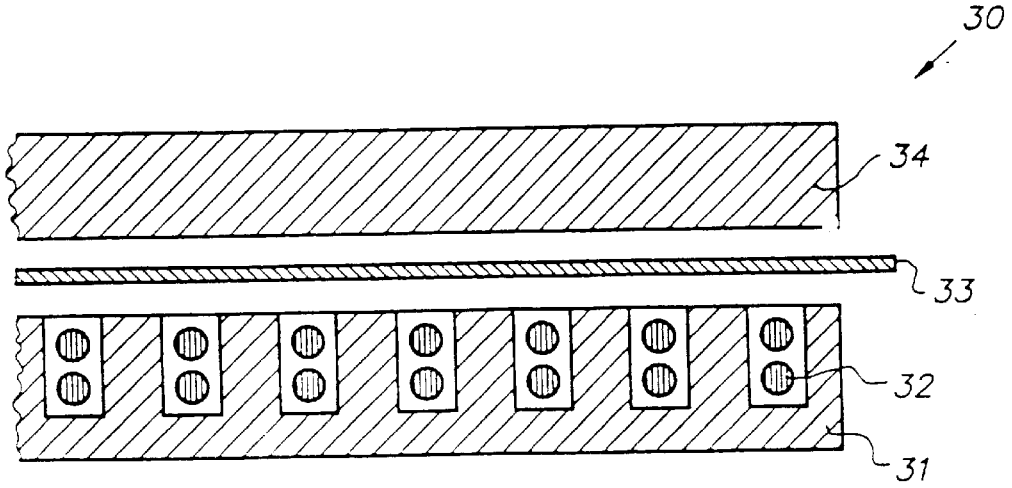
FIG. 3 PRIOR ART
FIG. 3 is a schematic sectional view of a linear induction motor with single stator as known in the art.
Figure 4:
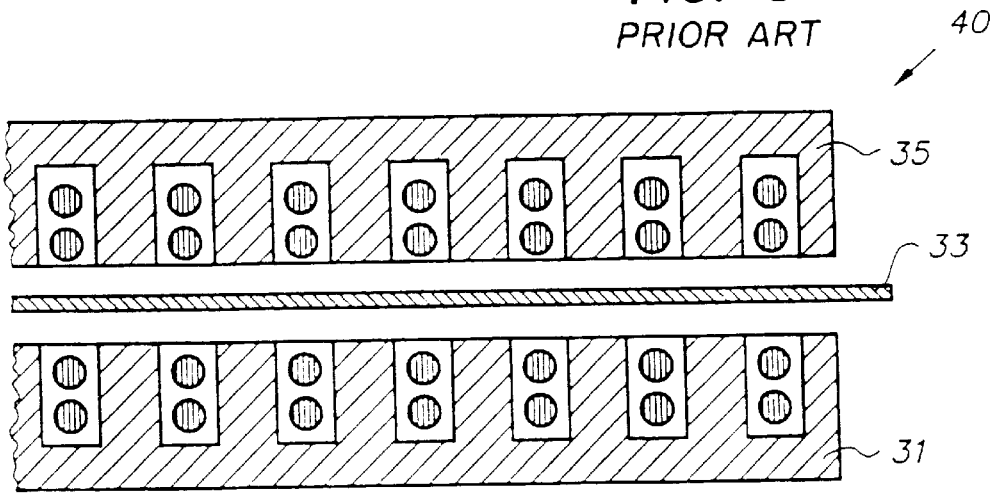
FIG. 4 PRIOR ART
FIG. 4 is a schematic sectional view of a linear induction motor with double stator as known in the art.
Figure 5:
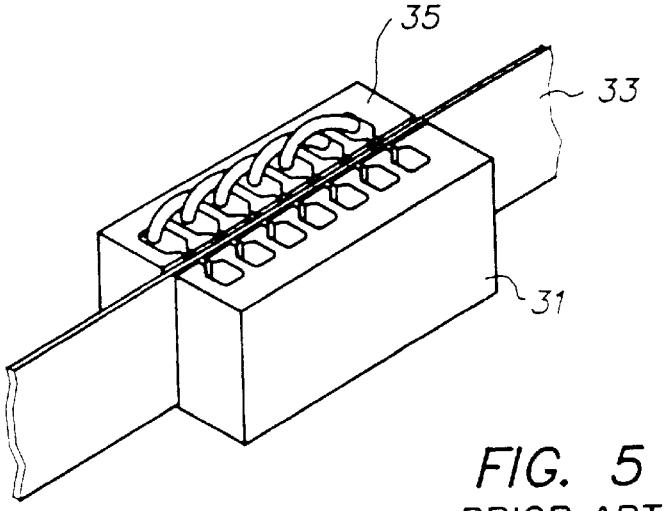
FIG. 5 PRIOR ART
FIG. 5 is an exploded view of a linear motor with double stator as known in the art.

FIG. 3 is a schematic sectional view of a linear induction motor 30 with single stator as known in the art. The primary section 31 of the motor is provided with slots in which the electric windings 32 are mounted. The secondary section of the motor consists of a flat electric conductor 33 made of non-magnetizable material (e.g. copper), which is located between the primary section 31 of the motor and an armature 34 of a permanent magnet. FIG. 4 is a schematic sectional view of a linear induction motor 40 with double stator 31, 35 as known in the art. FIG. 5 is an exploded view of a linear motor 40 with double stator 31, 35 as known in the art.

Hereinbelow, a second device according to the present invention will be described for conveying magnetically attractable particles from a first position to a second position comprising a conveying means located between said first position and said second position and containing a magnetic-field producing means that is transferring said particles from said first position to said second position wherein said magnetic-field producing means is an induction electromotor. Typically, this second embodiment comprises a converted linear induction electromotor (in FIG. 7, which will be discussed further hereinbelow such a magnetic-field producing means is indicated with reference number 10, said first position with 11 and said second position with 12).

A second series of experiments has been conducted on the basis of a converted linear induction electromotor. Although tests were carried out both with a motor 30 of the type with single stator and with a motor 40 of the type with double stator, the further description will focus merely on a converted linear motor of the type with single stator.

The series of experiments was conducted a.o. with a converted motor of the type LMKK 14-3.2/314 manufactured by DEMAG MANNESMAN, Postfach 50 03 25, D-22705 Hamburg, Germany.

In a first test arrangement included in the series of experiments translator 33 was exchanged for a protective covering film of electrically non-conductive and non-magnetic material (e.g. plastic) covered by magnetizable particles to be conveyed 4. The conveyance result was virtually zero and was evaluated with a classification figure of "0 to 10".

In a second test arrangement a magnetic film or foil (on a rubber base) the magnet poles of which exhibited a recurring mutual distance and width of 6 mm each was mounted at a distance of a few mm from the stator. As a result, on the surface of the stator the physical distance between the sequential windings, which were constituting electromagnetic poles, could be affected by permanent-magnet poles with a view to a more continuous distribution of flux around the stator. The conveyance result of the present embodiment showed a slight improvement, but still remained very poor and was evaluated with a classification figure of "3 to 10". Accurate measurements of the magnetic-field intensities revealed that an imbalance occurred between the positive and the negative flux variations around said magnet poles.

In a third test arrangement no magnetic film or foil was mounted, but instead a semiconductor diode was installed in every phase of the motor or stator power supply. As a result, the cycles of the magnetic flux applied by the stator windings were rectified in a way that the magnetizable particles 4 were subjected to a uniform and more even force. A time interval of this flux is represented in FIG. 6.1 and 6.2, wherein FIG. 6.1 represents the magnetic flux applied by the windings of a conventional stator and FIG. 6.2 the magnetic flux applied by the windings of a stator fed by semiconductor diodes. The conveyance result of the present third test arrangement was substantially better and was evaluated with a classification figure of "6 to 10".

In a fourth test arrangement an end-plate 36 or foil made of magnetizable material, e.g. iron or steel, having a thickness of approximatively 1 mm was mounted at a distance of a few mm from the stator. In this case the space between end-plate 36 and stator 31 was available for the magnetizable particles 4. FIG. 7 shows a similar converted linear motor 70 according to the present invention. The conveyance result improved up to a classification of "7 to 10". A flux measurement using a HALL sensor recorded 3300 to 3960 Gauss (peak values), whereas the flux measuring result dropped to 2200 Gauss (peak values) if a PVC plate having a thickness of 2.5 mm was mounted between motor and toner particles.

It should be mentioned that in each of the above-described embodiments of the present invention said particles 4 may be magnetic toner particles or multicomponent magnetic developer particles. For further information on such particles and their application in a developing device reference is made a.o. to our EP-A 93,201,795.7-PCT-EP-94/01855.

In another embodiment of the present invention said first position 11 comprises a feed system for supplying particles and said second position 12 comprises a removal system for removing said particles. In a more specific embodiment said feed system comprises a supply vessel and a metering means for controlling the amount of transferred particles.

In still another embodiment of the present invention said removal system comprises an electrostatic imaging element 7, preferably a photoconductor, wherein the particles are transferred directly from the conveying device to the imaging element.

Figure 8:
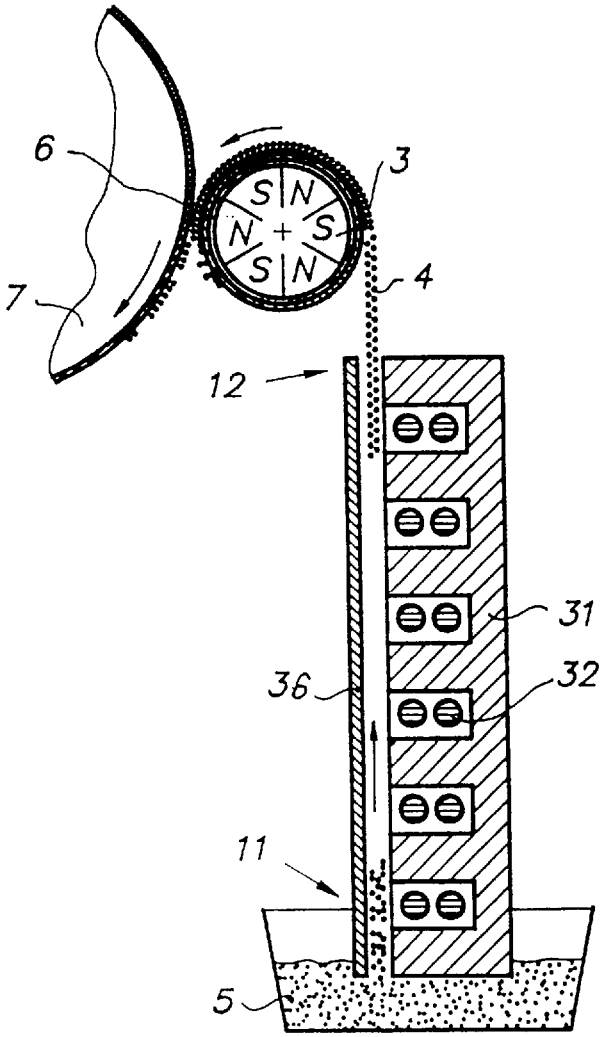
FIG. 8 shows a converted linear motor combined with a magnetic brush according to the present invention.

In still a further embodiment of the present invention said removal system comprises a magnetic brush transferring the removed particles to an electrostatic imaging element, preferably a photoconductor. FIG. 8 shows a converted linear motor combined with a magnetic brush according to the present invention. In this FIG. but a few basic elements are indicated with reference numbers, such as magnetic brush 3, particles 4, supply 5, development zone 6, photoconductor 7, first position 11, second position 12, stator 31, stator windings 32, end-plate 36. Following typical benefits became apparent from the present embodiment : the possibility of vertical upward conveyance of magnetizable particles and the practicability of (conventional) magnetic brushes on locations difficult of access.

Figure 9:
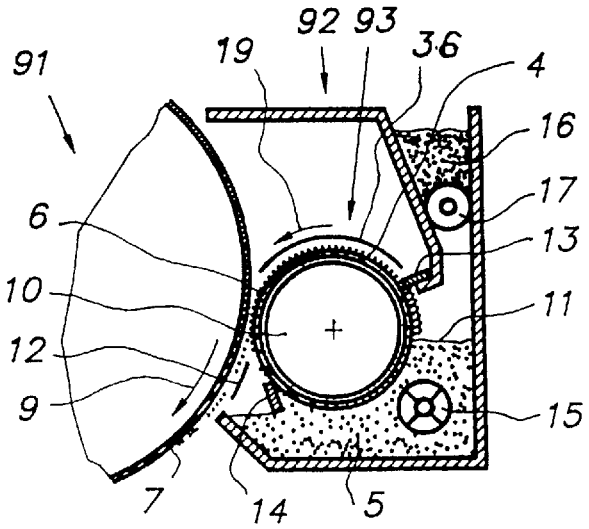
FIG. 9 shows an electrophotographic apparatus with a developing unit provided with a converted electromotor according to the present invention.

A more integrated preferential embodiment of the present invention comprises an electrophotographic apparatus, e.g. copier or printer, having a developing device in accordance with any of the preceding descriptions. FIG. 9 shows a similar electrophotographic apparatus 91 with a developing unit 92 provided with a converted electromotor 93 according to the present invention. It is assumed that an electrostatic latent image has been formed on a photoconductor 7 that had been previously charged and exposed (not represented in this FIG.). Photoconductor 7 is revolving in the direction indicated by arrow 9. A rotary conveying device 92 according to the present invention (inclusive of an armature 36 for permanent magnet) is mounted in the proximity of the photoconductor 7 and is revolving in the opposite sense of rotation 19.

As the design and the operation of a developing device with an induction motor as represented in FIG. 7 are very similar to those of a developing device with a magnetic brush as shown in FIG. 1, for clarity's sake in the detailed description following hereinbelow similar component parts exhibiting a similar construction and a similar function are indicated with one and the same reference number.

The amount of drawn particles 4 is controlled by a coating-thickness control means or doctor blade 13 before reaching the development zone 6. Part of these particles is picked up electrostatically by the photoconductor 7, whereas the remaining particles continue to move throughout the surface of the motor and eventually return to the supply holder 5 after having passed a scraping means or cleaning blade 14. Optionally, a mixing system 15, such as a rotating paddle, may ensure an intimate mixing of toner and carrier particles. To prevent toner exhaustion a feed system or toner hopper 16 is provided, e.g. with a feed roller 17.

It should be mentioned that both the described rotary field in the case of a rotary electromotor and the described travelling the field in case of a linear electromotor may be generated by means of a three-phase power voltage, as well as by means of a single-phase power voltage with an additional auxiliary condenser, as well as by means of an electronic commutation. By way of example, FIG. 10.1 is a standard wiring diagram for a linear electromotor with double stator 31,35 for a power supply by means of a three-phase voltage; when interchanging two connecting wires (see on the' right-hand side of the diagram) the direction of motion of the field and thus of the particles to be conveyed are altered. FIG. 10.2 is a typical wiring diagram for a linear electromotor with single stator the six ends of the three windings being arranged for receiving the connection 37 of control devices.

Under given load conditions the speed of a rotary or linear induction motor is defined by the motor design and by the frequency of the power supply the motor has been connected to. Consequently, a continuous speed control is (but) possible by varying the frequency of the supply voltage, applied to the stator, by means of a frequency changer. On the one hand, the recent progress in the field of power electronics enabled the manufacture of increasingly enhanced equipment for frequency control and correspondingly for speed control; on the other hand, the servicing expenses for mechanical installations are increasingly rising. Therefore, a linear motor will now often constitute a useful alternative for a regular motor in combination with a mechanical transmission.

Electrophotographic processes are suitable for use not only for monochrome or black-and-white images but also for polychromatic or multicolor images. For the latter images several color separations can be developed in sequence by using cyan, magenta, yellow and/or black toners. On occasion, colorless toners may be used also.

We claim:

1. An apparatus for conveying magnetically attractable particles from a first position to a second position, comprising:

a stator;

an end-plate made of magnetizable material, said stator and said end-plate defining a channel therebetween;

electric windings disposed within said stator; and means for supplying electric current to said windings to generate a magnetic field in said channel, said magnetic field applying a force to move the particles from said first position to said second position.

2. An apparatus as in claim 1, wherein said particles are magnetic toner particles or magnetic developer particles.

3. An apparatus as in claim 1, wherein said first position comprises a feed system for supplying said particles and said second position comprises a removal system for removing said particles.

4. An apparatus as in claim 3, wherein said feed system comprises a supply vessel and a metering means for controlling the amount of transferred particles.

5. An apparatus as in claim 3, wherein said removal system comprises an electrostatic imaging element.

6. An apparatus as in claim 3, wherein said removal system comprises a magnetic brush that is arranged to transfer the removed particles to an electrostatic imaging element.

7. An apparatus as in claim 5, wherein said imaging element comprises a photoconductor.

8. An apparatus as in claim 6, wherein said imaging element comprises a photoconductor.

9. An apparatus as in claim 1 wherein said stator and said end-plate are parallel and arranged linearly.

10. An apparatus as in claim 1 wherein said stator is curved and said end-plate is at least partially concentric around said stator.

11. Electrophotographic apparatus comprising:

a stator;

an end-plate made of magnetizable material, said stator and said end-plate defining a channel therebetween, through which magnetically attractable particles are conveyed;

electric windings disposed within said stator;

means for supplying electric current to said windings to generate a magnetic field in said channel, said magnetic field applying a force to move the particles from a first position to a second position; and means for forming said particles into an image.

* * * * *